US005332029A

United States Patent [19]

Tokai et al.

[11] Patent Number: 5,332,029

[45] Date of Patent: Jul. 26, 1994

[54] REGENERATOR

[75] Inventors: Yoichi Tokai, Yokohama; Akiko Takahashi, Tokyo, both of Japan

[73] Assignee: Kabushiki Kaisha Toshiba, Kawasaki, Japan

[21] Appl. No.: 999,715

[22] Filed: Dec. 31, 1992

[30] Foreign Application Priority Data

Jan. 8, 1992 [JP] Japan ..... 4-001375
Sep. 30, 1992 [JP] Japan ..... 4-261862

[51] Int. Cl.[5] ..... F28D 17/02
[52] U.S. Cl. ..... 165/4; 165/10; 62/6
[58] Field of Search ..... 165/4, 10; 62/6, 3.1

[56] References Cited

U.S. PATENT DOCUMENTS 4,082,138 4/1978 Miedema et al. ..... 62/6
4,332,135 6/1982 Barclay et al. ..... 62/3.1
4,829,770 5/1989 Hashimoto ..... 62/3.1
5,186,765 2/1993 Arai et al. ..... 165/4

FOREIGN PATENT DOCUMENTS 0411591 2/1991 European Pat. Off. .
0477917 4/1992 European Pat. Off. .
2283414 3/1976 France .

OTHER PUBLICATIONS

European Search Report No. EP 93 30 0063, dated Dec. 29, 1993.
Database Inspec Institute of Electrical Engineers, Stevenage, GB Inspec No. 3162342 Abstract.
Advances in Cryogenic Engineering Materials, vol. 32, pp. 295–301, A. Tomokiyo, et al., "Specific Heat and Entropy of $RNi_2$ (R: Rare Earth Heavy Metals) in Magnetic Field".
Advances in Cryogenic Engineering Materials, vol. 32, pp. 271–278, B. Barbrish, et al., "High Enthalpy Materials for Use in Superconductor Stabilization and in Low . . . ".

*Primary Examiner*—Albert W. Davis, Jr.
*Attorney, Agent, or Firm*—Oblon, Spivak, McClelland, Maier & Neustadt

[57] ABSTRACT

Disclosed is a regenerator loaded with a relatively cheap heat regenerative material which exhibits excellent specific heat, heat transfer capability and recuperativeness under cryogenic temperatures lower than, for example, the liquid nitrogen temperature. The regenerator is filled with a heat regenerative material comprising at least one R-M system compound, where R is at least one rare earth element selected from the group consisting of Y, La, Ce, Pr, Nd, Pm, Sm, Eu, Gd, Tb, Dy, HO, Er, Tm, Yb and Lu, and M is at least one metal selected from the group consisting of Al, Ga, In and Tl.

20 Claims, 6 Drawing Sheets

REGENERATOR

BACKGROUND OF THE INVENTION

1. Field of the Invention

The present invention relates to a regenerator which is filled with a heat regenerative material.

The invention also relates to a refrigerator regenerator which exhibits an excellent heat transfer capability and recuperativeness.

2. Description of the Prior Art

In recent years, superconduction technology has remarkably advanced and has been applied to more and more technical fields. Along with the increasing use of the technology, demands are increasing for a high-efficiency, small refrigerator for cooling superconductive components. In other words, it is greatly demanded that a refrigerator be developed which is light and small and has a high heat efficiency. At present, such refrigerators are being developed in two ways. The first method is to enhance the efficiency of the existing gas-cycle refrigerator by adopting, for example, the Stirling cycle. The second method is to employ new refrigeration system in place of the conventional gas-cycle refrigeration. The new refrigeration system includes heat-cycle using magnetocaloric effect, such as a Carnot-type and an Ericsson-type cycle.

Among the gas-cycle refrigerators with enhanced efficiency are: a refrigerator which operates in the Stirling cycle; a refrigerator which operates in the vuilleumier cycle; and a refrigerator which operates In the Gifford-McMahon cycle. Each of these refrigerators has a regenerator packed with heat regenerative materials. A working medium is repeatedly passed through the regenerator, thereby obtaining a low temperature. More specifically, the working medium is first compressed and then made to flow in one direction through the regenerator. As the medium flows through the regenerator, heat energy is transferred from the medium to the heat generative materials. Thus, the working medium is deprived of heat energy. When the medium flows out of the regenerator, it is expanded to have its temperature lowered further. The working medium is then made to flow in the opposite direction through the regenerator again. This time, heat energy is transferred from the heat regenerative materials to the medium. The medium is passed twice, back and forth, through the regenerator in one refrigeration cycle. This cycle is repeated, thereby obtaining a low temperature.

The recuperativeness of the heat regenerative materials is the determinant of the efficiency of the refrigerator. The heat efficiency of each refrigeration cycle is increased with increase in the recuperativeness the heat regenerative materials.

The heat regenerative materials used in the conventional regenerators are particles of lead or bronze particles, or nets of copper or phosphor bronze. These heat regenerative materials exhibit but a small specific heat at cryogenic temperatures of 20K or less. Hence, they cannot sufficiently accumulate heat energy at cryogenic temperatures, in each refrigeration cycle of the gas-cycle refrigerator. Nor can they supply sufficient heat energy to the working medium. Consequently, any gas-cycle refrigerator which has a regenerator filled with such heat regenerative materials fails to obtain an cryogenic temperatures.

This problem can be solved by using heat regenerative materials which exhibit a great specific heat per unit volume (i.e., volume specific heat) at cryogenic temperatures. Much attention is paid to some kinds of magnetic substances as such heat regenerative materials, since they exhibit magnetocaloric effect, that is, their specific heats greatly change at their magnetic transition temperatures. Hence, any magnetic substance, whose magnetic transition temperature is extremely low, can make excellent regenerative materials.

One of such magnetic substances is the R-Rh intermetallic compound (where R is Sm, Gd, Tb, Dy, Ho, Er, Tm, or Yb) disclosed in Japanese Patent Disclosure No. 51-52378. This compound has a maximal value of volume specific heat which is sufficiently great at 20K or less.

One of the components of this intermetallic compound is rhodium (Rh). Rhodium is a very expensive material. In view of this, it is not suitable as a component of heat regenerative materials which are used in a regenerator in an amount of hundreds of grams.

The R-Rh intermetallic compound has a small volume specific heat at temperatures higher than 20K. This is because the compound has but a small lattice specific heat. The lattice specific heat is largely responsible for the volume specific heat of the compound unless the volume specific heat increases due to the magnetocaloric effect. Hence, other heat regenerative materials must be used to obtain a low temperature down to 20K in a gas-cycle refrigerator system utilizing the R-Rh intermetallic compound.

Conventionally, copper is used as the heat regenerative material for cooling from room temperature down to about 40K, and lead is used as the heat regenerative material for cooling from 40K down to about 20K. Therefore, in order to obtain an cryogenic temperatures of less than 20K in a refrigerator system utilizing the R-Rh intermetallic compound, the three different heat regenerative materials (Cu, Pb and R-Rh compound) will have to be successively used in accordance with the temperature ranges which the refrigerator system reaches.

SUMMARY OF THE INVENTION

An object of the present invention is to provide a regenerator filled with a relatively cheap heat regenerative material which exhibits an excellent specific heat, an excellent heat transfer capability, and an excellent recuperativeness at cryogenic temperatures, e.g., temperatures lower than the liquid nitrogen temperature.

Another object is to provide a small refrigerator which exhibits an excellent heat transfer capability and recuperativeness.

According to one aspect of the present invention, there is provided a regenerator filled with a heat regenerative material comprising at least one R-M system compound, where R is at least one rare earth element selected from the group consisting of Y, La, Ce, Pt, Nd, Pm, Sm, Eu, Gd, Tb, Dy, Ho, Er, Tm, Yb and Lu; M is at least one metal selected from the group consisting of Al, Ga, In and Tl. This regenerator can give and take a great deal of thermal energy at cryogenic temperatures, and is yet relatively inexpensive.

According to another aspect of the present invention, there is provided a refrigerator comprising:

a refrigerant; and a heat regenerative material for performing heat-exchange between said refrigerant and itself, wherein said heat regenerative material comprises at least one R-M system compound, where R is at least one rare earth element selected from the group consisting of Y, La, Ce, Pr, Nd, Pm, Sm, Eu, Gd, Tb, Dy, Ho, Er, Tm, Yb and Lu; M is at least one metal selected from the group consisting of Al, Ga, In and Tl. This refrigerator, which can be miniaturized, exhibits an excellent heat transfer capability and an excellent recuperativeness so as to achieve a high heat efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1C:
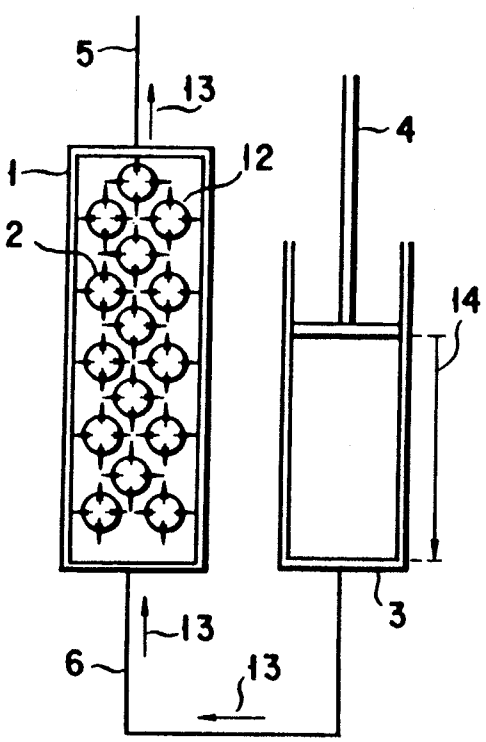
FIGS. 1A to 1C schematically show the gas-cycle of a refrigerator including a regenerator according to one embodiment of the present invention.

A regenerator according to the present invention is filled with a heat regenerative material comprising at least one R-M system compound, where R is at least one rare earth element selected from the group consisting of Y, La, Ce, Pr, Nd, Pm, Sm, Eu, Gd, Tb, Dy, Ho, Er, Tm, Yb and Lu; M is at least one metal selected from the group consisting of Al, Ga, In and Tl.

It is possible for the R-M system compound to assume the crystal shape of, for example, hexagonal system, cubic system, tetragonal system and rhombic system.

Desirably, the R-M system compound should have a composition represented by general formula (I) given below:

$$RAl_z \quad (I)$$

where R is at least one rare earth element selected from the group consisting of Y, La, Ce, Pt, Nd, Pm, Sm, Eu, Gd, Tb, Dy, Ho, Er, Tm, Yb and Lu; and z is defined as $0.001 \leqq z \leqq 1$.

If the value of z in formula (I) is smaller than 0.001, the temperature at which the compound exhibits the peak value of the specific heat tends to be higher than 40K because of the mutual function for direct exchange between the rare earth element atoms. If the value x exceeds 1, however, the density of the rare earth element atoms is markedly lowered, leading to a low magnetic specific heat. Where the value z falls within the range denoted above, the heat regenerative material comprising the particular compound exhibits an excellent heat regenerative characteristics. Further, it is possible to obtain a heat regenerative material exhibiting a further improved lattice specific heat on the higher temperature side.

It is possible for the R-M system compound to have a perovskite structure. Desirably, the R-M system compound of the perovskite structure should have a composition represented by general formula (II) given below:

$$(R1_{1-x}R2_x)_3M1M2_z \quad (II)$$

where R1 is at least one element selected from the group consisting of Dy, Ho, Er, Tm and Yb; R2 is at least one element selected from the group consisting of Sc, La, Y, Ce, Nd, Sm, Eu, Gd, Tb and Lu; M1 is at least one metal selected from the group consisting of Al, Ga, In and Tl; M2 is at least one element selected from the group consisting of C, Si, Ge and B; and x and z are individually defined as $0 \leqq x \leqq 1$, $0 \leqq z \leqq 1$.

Al and C is preferable for M1 and M2, respectively.

It is preferable that the compound represented by general formula (II) contains a heavy rare earth element R1 such as Er ($x<1$). Since the element R1 forms an alloy together with a metal such as Al, a heat regenerative material containing the particular compound exhibits a particularly prominent magnetic specific heat, making it possible to set the maximal peak value of the specific heat at a large value. Also, element R2 such as Gd, Tb, Pr, Nd, Sm or Ce is partly substituted for the heavy rare earth element R1 in the compound represented by general formula (II). Particularly, Gd and Tb included in element R2 are effective for improving the temperature characteristics interms of the specific heat. It follows that, in the heat regenerative material containing the particular compound, it is possible to control the maximal value and temperature width (half-value width) of the peak of the specific heat by utilizing, for example, the Schottky abnormality. It is acceptable for the composition of the compound to be somewhat deviant from the stoichiometric range. It is also acceptable for traces of an auxiliary phase to be present together with a main phase provided by the compound of the particular composition.

M1 can be partly replaced with a transition metal, such as Ag, Au, Mg, Zn, Ru, Pd, Pt, Re, Cs, Ir, Fe, Mn, Cr, Cd, Hg and Os.

It is possible for the R-M system compound to be amorphous. Desirably, the amorphous R-M system compound should have a composition represented by general formula (II) described previously.

The heat regenerative material used in the present invention should desirably be in the form of particles or filaments having an average diameter of 1 to 1,000 μm. The material of this form is regularly loaded in a three dimensional direction so as to achieve a uniform heat transfer and reduction in the pressure loss.

It is important to define appropriately the average diameter of the heat regenerative material in the form of particles or filaments. If the average diameter of the particles or filaments is less than 1 μm the heat regenerative material loaded in a regenerator tends to flow out of the regenerator together with a high pressure working medium such as a helium gas. If the average diameter is larger than 1,000 μm, however, the heat transfer between the heat regenerative material and the working medium is determined by the heat conductivity of the heat regenerative material. As a result, the heat transfer capability is markedly lowered. In addition, the recuperativeness is markedly lowered.

The upper limit in the average diameter of the heat regenerative material in the form of particles or filaments is set at 1,000 μm in the present invention It should be noted in this connection that, in order to fully utilize the heat capacity of the heat regenerative material, the material is required to exhibit a high heat conductivity conforming with its large volume specific heat $\rho Cp$ where $\rho$ is the density and Cp is the specific heat of the heat regenerative material. To be more specific, the heat immersion depth ld determining the effective volume of the heat regenerative material contributing to the heat accumulation is given as follows:

$$ld = [(\rho Cp\pi f)/\lambda]^{\frac{1}{2}}$$

where $\lambda$ is the heat conductivity, $\rho$ is the density of the heat regenerative material, Cp is the specific heat of the heat regenerative material, and $\pi f$ is the refrigeration cycle frequency. It follows that, in the case of using $Ho_2Al$ having a volume specific heat $\rho Cp$ as large as 0.3 $J/cm^3$ at 9K or more as a heat regenerative material, the heat immersion depth ld is about 600 μm in relation to its heat conductivity (80 mW/Kcm). Such being the situation, it is desirable to set the upper limit in the average diameter of the heat regenerative material in the form of particles or filaments at 1,000 μm.

The heat regenerative material in the form of particles should more desirably be spherical. The spherical particles can be prepared by any of methods (a) to (f) given below:

(a) To drop the molten compound into water or oil for solidification.

(b) To inject the molten compound into a turbulent flow of a liquid or a gas.

(c) To drop or inject the molten compound onto a metal coolant on a plate or a hollow cylinder.

(d) To heat particles of the compound, which have various shapes, and inject them into a flow of an inert gas such as an argon gas.

(e) To prepare an electrode rod of the compound and subject the electrode rod to an arc melting while rotating the rod within an inert gas such as an argon gas for centrifugal spraying.

(f) To inject the molten compound onto a disk or cone rotating within an inert gas such as an argon gas.

It is desirable to set the inert gas pressure at the atmospheric pressure or more in any of methods (d) to (f) given above. The inert gas pressure specified in the present invention permits improving the cooling efficiency of the molten particles running within the inert gas atmosphere, with the result that the molten particles made spherical by the surface tension are solidified as they are. It follows that it is possible to obtain substantially completely spherical particles of the heat regenerative material.

Of methods (a) to (f) given above, method (f) is particularly practical.

In preparing the filaments of the heat regenerative material, woven fabrics made of metal fibers such as W or B fibers, glass fibers, carbon fibers, plastic fibers, etc. are used as a core material. Then, the core material is coated with the compound specified in the present invention by a gaseous phase growth method such as flame-spraying or sputtering or by a liquid phase growth method.

At least two kinds of the heat regenerative materials containing the compound specified in the present invention may be loaded together in a regenerator of the present invention.

It is particularly desirable for the regenerator of the present invention to be constructed as summarized below:

(1) A regenerator loaded with particles or filaments of at least one kind of the heat regenerative material containing a compound represented by general formula (I), said particles or filaments having an average diameter of 1 to 1,000 μm.

(2) A regenerator loaded with particles or filaments of at least one kind of the heat regenerative material containing a compound represented by general formula (II), said particles or filaments having an average diameter of 1 to 1,000 μm.

The present invention also provides a refrigerator comprising:

a refrigerant; and a heat regenerative material for performing heat-exchange between said refrigerant and itself, wherein said heat regenerative material comprises at least one R-M system compound, where R is at least one rare earth element selected from the group consisting of Y, La, Ce, Pt, Nd, Pm, Sm, Eu, Gd, Tb, Dy, Ho, Er, Tm, Yb and Lu; and M is at least one metal selected from the group consisting of Al, Ga, In and Tl.

The refrigerant used in the refrigerator of the present invention can be provided by, for example, a helium gas.

The R-M system compound should desirably have a composition represented by general formula (I) described previously. Also, the R-M system compound may be of perovskite structure. It is desirable for the R-M system compound of perovskite structure to have a composition represented by general formula (II) described previously.

The R-M system compound may be amorphous. The amorphous R-M system compound should desirably have a composition represented by general formula (II).

As described previously, the heat regenerative material should desirably be in the form of particles or filaments having an average diameter of 1 to 1,000 μm. The heat-regenerative material of the particular form can be regularly loaded in three dimensional direction so as to achieve a uniform heat transfer and reduction of pressure loss.

Figure 1B:
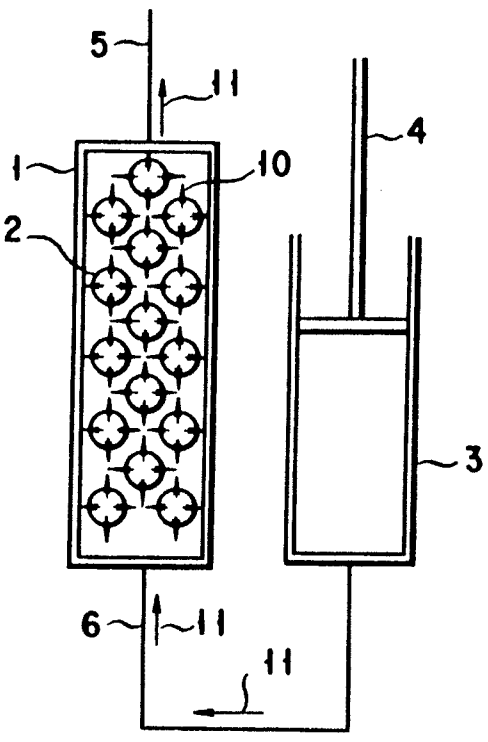
Figure 1A:
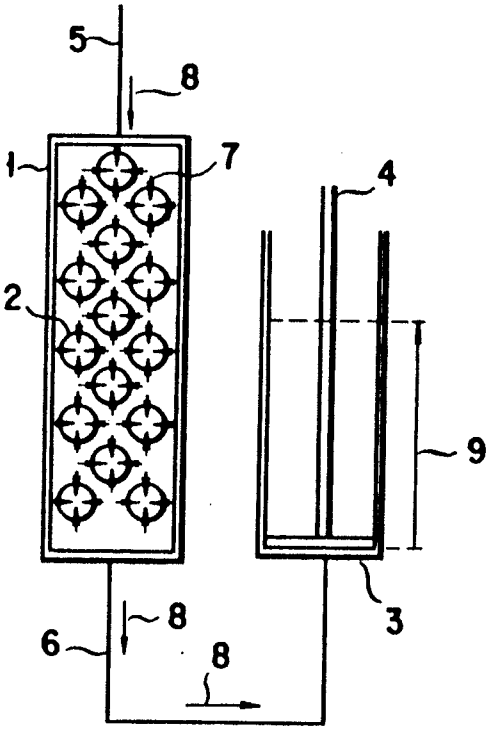

The gas-cycle of the refrigerator including the regenerator described previously is carried out as follows. As schematically shown in FIGS. 1A to 1C, a regenerator 1 is filled with a heat regenerative material 2. One end of the regenerator 1 is connected to a working medium source (not shown) by a pipe 5. The other end of the regenerator 1 is connected to an expansion cylinder 3 by a pipe 6. A piston 4 is slidably provided within the expansion cylinder 3. When the piston 4 is moved, the internal volume of the cylinder 3 is changed.

The regenerator 1 is cooled in the following four steps I to IV which make one cycle of refrigeration.

In step I, as shown in FIG. 1A, the piston 4 is moved in the direction of an arrow 9, thereby increasing the internal volume of the expansion cylinder 3 and introducing a high-pressure gas from the working medium source into the cylinder 3, in the direction of an arrow 8. The high-pressure gas passes through the regenerator 1 before flowing into the expansion cylinder 3. As it passes through the regenerator 1, it is cooled by the heat regenerative material 2. The gas thus cooled is accumulated in the expansion cylinder 3.

In step II, as illustrated in FIG. 1B, a part of the gas is discharged from the expansion cylinder 3 in the direction of an arrow 11, while maintaining the internal volume of the cylinder 3. As a result, the gas remaining in the cylinder 3 expands, thus lowering the temperature in the expansion cylinder 3. The gas discharged from the cylinder 3 is applied into the regenerator 1 through the pipe 6. As this gas passes through the regenerator 1, it takes heat from the heat regenerative material 2. An arrow 11 represents the direction in which heat is transferred within the regenerator 1.

In step III, as shown in FIG. 1C, the piston 4 is moved in the direction of an arrow 14, thereby discharging the low-temperature, low-pressure gas from the expansion cylinder 3 into the regenerator 1 via the pipe 6 in the direction of an arrow 13. As this gas flows through the regenerator 1, it deprives the heat regenerative material 2 of heat. In other words, the gas cools the material 2. Arrows 12 indicate the direction in which heat is transferred within the regenerator 1.

In the last step Iv, the operation goes back to step I.

The regenerator of the present invention comprises a heat regenerative material comprising at least one system compound. The particular heat regenerative material exhibits such a high heat conductivity as 10 mW/cmK or more. Also, the heat regenerative material is used in the form of particles or filaments having a predetermined average diameter. The particular construction of the present invention makes it possible to provide a relatively cheap regenerator which exhibits an excellent lattice specific heat, an excellent heat transfer capability and an excellent recuperativeness at cryogenic temperatures lower than the liquid nitrogen temperature, particularly cryogenic temperatures lower than 40K. Particularly, the heat regenerative material comprising at least one kind of R-M system compound represented by $R_3AlC$, permits improving the lattice specific heat on the high temperature side.

The regenerator according to another embodiment of the present invention comprises a heat regenerative material comprising at least one kind of the R-M system compound of the perovskite structure. Also, the heat regenerative material is loaded in the form of particles or filaments having a predetermined average diameter. The particular construction of the present invention makes it possible to provide a relatively cheap regenerator which exhibits an excellent lattice specific heat, an excellent heat transfer capability and an excellent recuperativeness at cryogenic temperatures lower than the liquid nitrogen temperature, particularly cryogenic temperatures lower than 40K. Where the R-M system compound assumes a crystal structure of cubic system, the degree of energy degeneracy is increased by the crystal symmetric property of the compound. When the degeneracy is opened, a large energy is released, making it possible to obtain a large specific heat.

The regenerator according to still another embodiment of the present invention comprises a heat regenerative material comprising at least one kind of an amorphous R-M system compound. Also, the heat regenerative material is loaded in the form of particles or filaments having a predetermined average diameter. The particular construction of the present invention makes it possible to provide a relatively cheap regenerator which exhibits an excellent lattice specific heat, an excellent heat transfer capability and an excellent recuperativeness at cryogenic temperatures lower than the liquid nitrogen temperature, particularly cryogenic temperatures lower than 40K. It should also be noted that the heat regenerative material comprising at least one kind of an amorphous R-M system compound has a uniform texture and, thus, is unlikely to be pulverized. It follows that the regenerator comprising the particular heat regenerative material exhibits a long life.

What should also be noted is that a plurality of heat regenerative materials each comprising at least one kind of the R-M system compound can be loaded in the form of a mixture in the regenerator of the present invention. In this case, the peaks of the specific heat of the regenerator are broadened, though the heat capacity is decreased. Since the mixture exhibits a large specific heat over a broader temperature range, it is possible to obtain a regenerator exhibiting a further improved recuperativeness.

Further, it is possible to laminate one upon the other a plurality of heat regenerative materials each comprising at least one kind of the R-M system compound such that the temperature at which each layer of the heat regenerative material exhibits the peak of specific heat conforms with the temperature gradient of the regenerator. The regenerator of the particular construction exhibits a further improved recuperativeness.

The refrigerator of the present invention comprises the regenerator described previously, making it possible to provide a small refrigerator which exhibits an excellent heat transfer capability and recuperativeness.

Some examples of the present invention will now be described in detail.

EXAMPLES 1 AND 2

Two alloys i.e. $Er_2Al$ and $Ho_2Al$, were prepared by using an arc furnace. Each of these alloys was centrifugally sprayed within a helium gas atmosphere so as to obtain two kinds of heat regenerative materials.

The heat regenerative materials obtained in Examples 1 and 2 were observed by using SEM photographs. Each of these heat regenerative materials has been found to be in the form of spherical particles having an average diameter of 100 to 400 μm.

Figure 2:
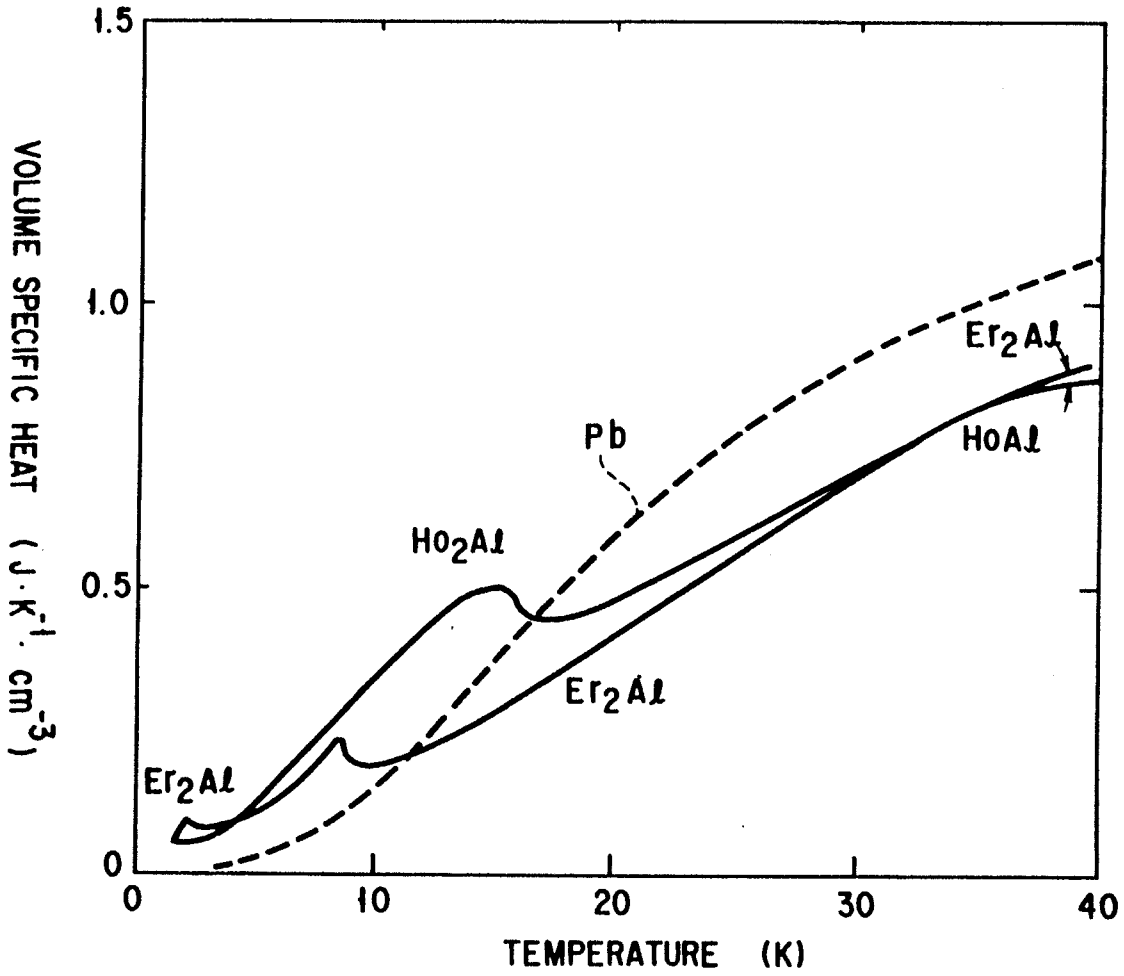
FIG. 2 is a graph showing the volume specific heats under low temperatures of the spherical heat regenerative materials according to Examples 1 and 2 of the present invention and the conventional heat regenerative material consisting of Pb.

The volume specific heat of each of these heat regenerative materials was measured, with the results as shown in FIG. 2. The volume specific heat of Pb is also shown in FIG. 2 as a control case. As apparent from FIG. 2, the heat regenerative material of any of Examples 1 and 2 is markedly superior in volume specific heat to the conventional heat regenerative material of Pb under cryogenic temperatures lower than about 15K. Also, the heat regenerative materials of the present invention exhibit an excellent lattice specific heat under temperatures higher than 15K.

Further, the spherical particles of $Ho_2Al$ alloy having an average particle diameter of 200 to 300 μm were filled in a container made of phenolic resin at the filling rate of 63% for the GM (Gifford-McMahon) refrigeration cycle. The GM refrigeration cycle was conducted by supplying a helium gas to the container at a mass flow rate of 3 g/sec under a pressure of 16 atms. It has been found that the regenerator loaded with the spherical particles of the heat regenerative material noted above permits improving the efficiency to at least two times as high as that of a regenerator loaded with lead particles of the same average diameter with the same loading rate (control case) under cryogenic temperatures of 40K to 4K.

EXAMPLES 3 AND 4

Two kinds of alloys, i.e., an alloy of $Er_3AlC$, and an alloy of $Ho_3AlC$, were prepared by using an arc furnace. Each of these alloys was pulverized by an RDP method (Rotating Disk Process method), followed by classifying the pulverized alloy to obtain two kinds of heat regenerative materials each having an average diameter of 200 to 300 μm.

The heat regenerative materials obtained in Examples 3 and 4 were observed by using SEM photographs. Each of these materials has been found to be in the form of spherical particles having an average diameter of 200 to 300 μm.

Figure 3:
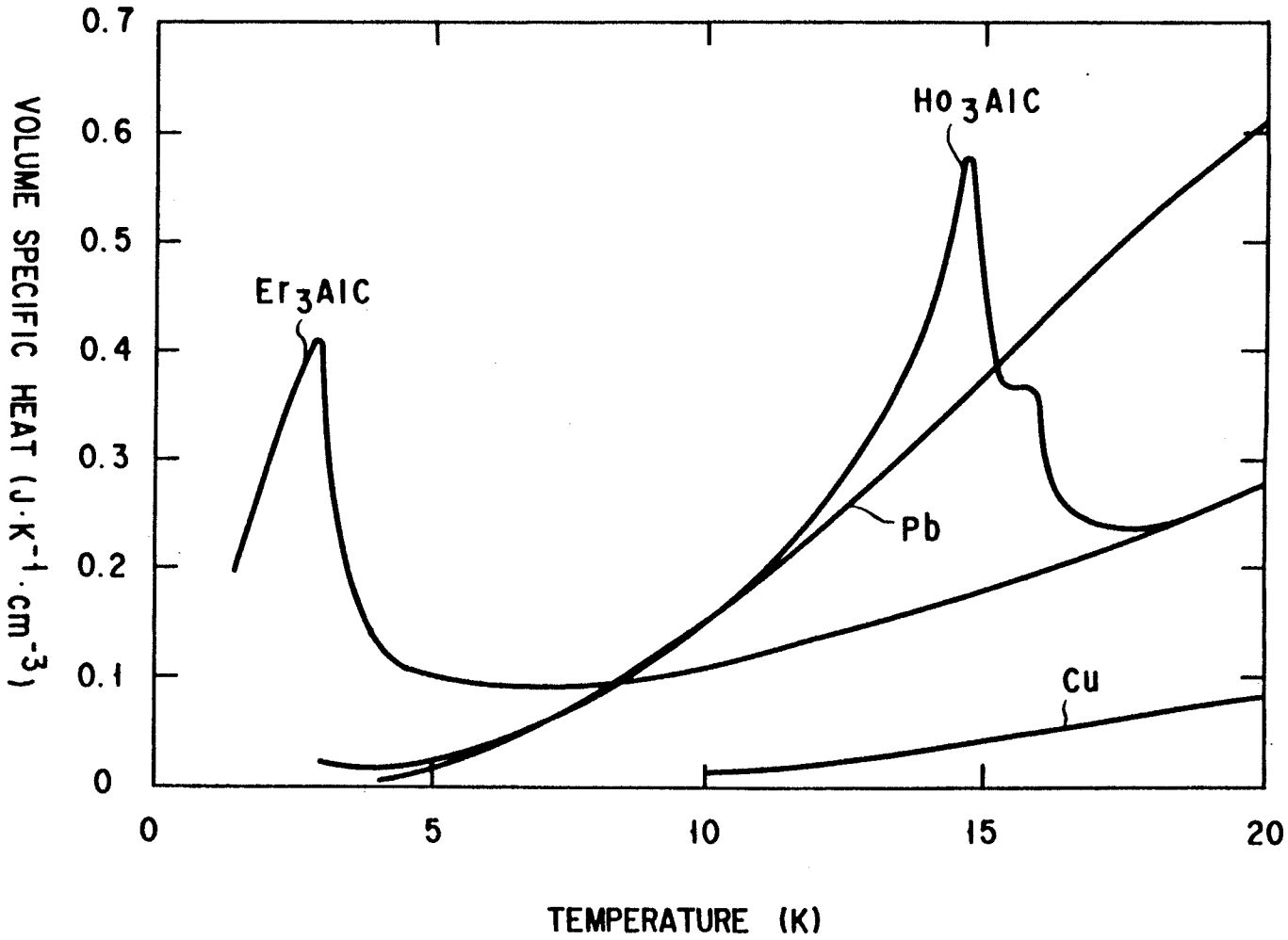
FIG. 3 is a graph showing the volume specific heats under low temperatures of the spherical heat regenerative materials according to Examples 3 and 4 of the present invention and the conventional heat regenerative material consisting of Pb or Cu.

The volume specific heat of each of these heat regenerative materials was measured, with the results as shown in FIG. 3. The volume specific heat of each of Pb and Cu, which are used as conventional heat regenerative materials, is also shown in FIG. 3 as a control case. As apparent from FIG. 3, the heat regenerative material of any of Examples 3 and 4 is markedly superior in volume specific heat to the conventional heat regenerative material consisting of Pb or Cu under cryogenic temperatures lower than about 15K. Also, the heat regenerative materials of the present invention exhibit an excellent lattice specific heat under temperatures higher than 15K.

Further, the spherical particles of $Er_3AlC$ alloy having an average particle diameter of 200 to 300 μm were filled in a container made of phenolic resin at the filling rate of 65% for the GM refrigeration cycle. The GM refrigeration cycle was conducted by supplying a helium gas to the container at a mass flow rate of 3 g/sec under a pressure of 16 atms. It has been found that the regenerator loaded with the spherical particles of the heat regenerative material noted above permits decreasing the loss of efficiency to ⅛ the value of a regenerator loaded with lead particles of the same average diameter with the same loading rate (control case) under cryogenic temperatures of 40K to 4K.

It is not necessary that M1 or R is composed of one element. Such as $(Er_{0.95}Gd_{0.05})_3AlC$, $Er_3(Al_{0.9}Ga_{0.1})C$ may be used.

EXAMPLES 5 AND 6

Three kinds of alloys, i.e., an alloy of $Er_3AlC$, and an alloy of $Ho_3AlC$ were prepared by using an arc furnace. Each of these alloys was melted and, then, rapidly cooled by the vacuum rolling method so as to obtain two kinds of amorphous wires.

Figure 4:
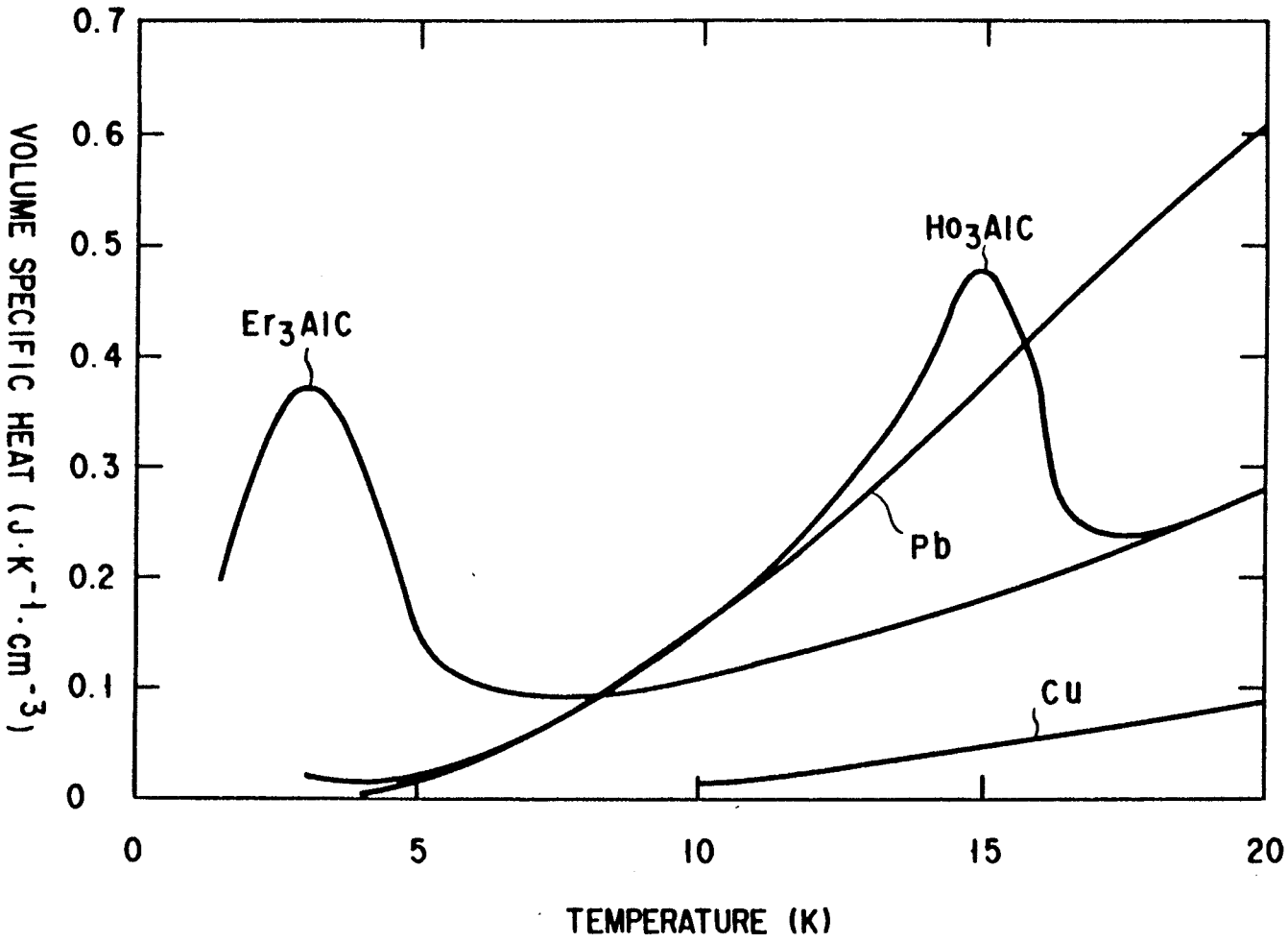
FIG. 4 is a graph showing the volume specific heats under low temperatures of the spherical heat regenerative materials according to Examples 5 and 6 of the present invention and the conventional heat regenerative material consisting of Pb or Cu.

The volume specific heat of each of these amorphous wires was measured, with the results as shown in FIG. 4. The volume specific heat of each of Pb and Cu, which are used as conventional heat regenerative materials, is also shown in FIG. 4 as a control case. As apparent from FIG. 4, the amorphous wire of any of Examples 5 and 6 is markedly superior in volume specific heat to the conventional heat regenerative material consisting of Pb or Cu under cryogenic temperatures lower than about 15K. Also, the amorphous wires of the present invention exhibit an excellent lattice specific heat under temperatures higher than 15K.

Further, a net of heat regenerative material was prepared by braiding the amorphous wires having a composition of $Er_3AlC$. The net thus prepared was filled in a container made of phenolic resin at the filling rate of 65% for the GM refrigeration cycle. The GM refrigeration cycle was conducted by supplying a helium gas to the container at a mass flow rate of 3 g/sec under a pressure of 16 atms. It has been found that the regenerator loaded with the net of the heat regenerative material noted above permits decreasing the loss of efficiency to ⅛ the value of a regenerator loaded with a net of lead of the same shape with the same loading rate (control case) under cryogenic temperatures of 40K to 4K. Further, the net of the heat regenerative material prepared by braiding the amorphous wires was not pulverized during operation of the regenerator.

EXAMPLE 7

Figure 5:
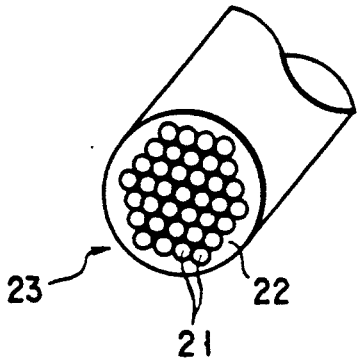
FIG. 5 is a perspective view showing a strand wire for forming a mesh used as a heat regenerative material in Example 7.
Figure 6:
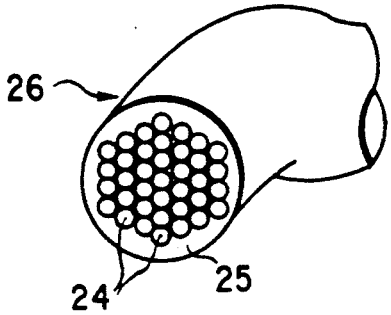
FIG. 6 is a perspective view showing a strand wire for forming a mesh used as a heat regenerative material in Example 7.
Figure 7:
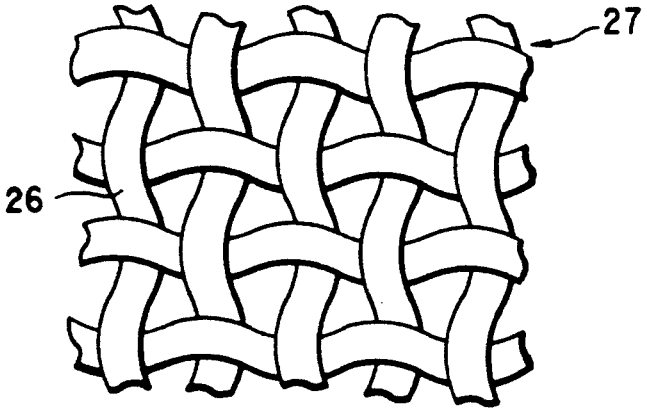
FIG. 7 schematically shows a mesh used as a heat regenerative material in Example 7.

Rods each having a diameter of 1 mm were prepared by using an alloy of $Er_3Al$. 37 alloy rods thus prepared were bundled together, followed by loading a carbon powder paste in the clearances among the alloy rods such that the composition of the bundle per unit length is $Er_3AlC$. After the solvent in the carbon paste was sufficiently removed by evaporation, an Er ribbon having a thickness of 0.1 mm was wound about the bundle, followed by drawing the resultant structure to form a wire 23 consisting of a plurality of composite phases 21 of $Er_3AlC$+Er and an Er surface layer 22, as shown in FIG. 5. 37 wires 23 of the particular structure were bundled together, followed by drawing the bundle to obtain a wire 26 having a diameter of 0.1 mm, the wire 26 consisting of a plurality of $Er_3AlC$ multi-core wires 24 and an Er outer layer 25 as shown in FIG. 6. Then, a plurality of wires 26 were braided, followed by applying a heat treatment at 700° C. for 100 hours to the braided structure to obtain a mesh 27 in which the clearance among the $Er_3AlC$ multi-core wires 24 and the surface of the wire 24 itself were covered with Er, as shown in FIG. 7.

The mesh thus prepared was used as a heat regenerative material, with the result that no deterioration of the heat regenerative material was recognized even after the continuous operation for more than 10,000 hours. Also, no deterioration caused by surface corrosion was recognized even after 10,000 hours of exposure of the mesh to a dry atmosphere.

EXAMPLE 8

Figure 8:
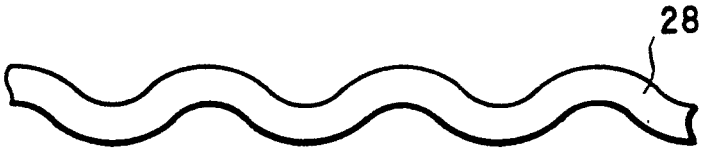
FIG. 8 schematically shows a wire for forming a porous thin plate used as a heat regenerative material in Example 8.
Figure 9:
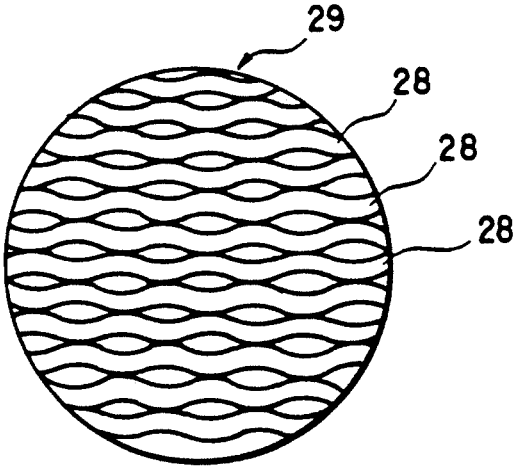
FIG. 9 schematically shows a porous thin plate used as a heat regenerative material in Example 8.

A wire having a diameter of 0.1 mm, which had been prepared as in Example 7, was bent to prepare a bent wire 28 as shown in FIG. 8. Then, a heat treatment was applied at 700° C. for 100 hours to an array of a plurality of these bent wires 28 to prepare a porous thin plate 29 in which the clearances among the $Er_3AlC$ multi-core wires and the surface of the wire itself were covered with Er, as shown in FIG. 9.

The porous thin plate thus prepared was used as a heat regenerative material, with the result that no deterioration of the heat regenerative material was recognized even after the continuous operation for more than 10,000 hours. Also, no deterioration caused by surface corrosion was recognized even after 10,000 hours of exposure of the porous thin plate to a dry atmosphere.

Figure 10:
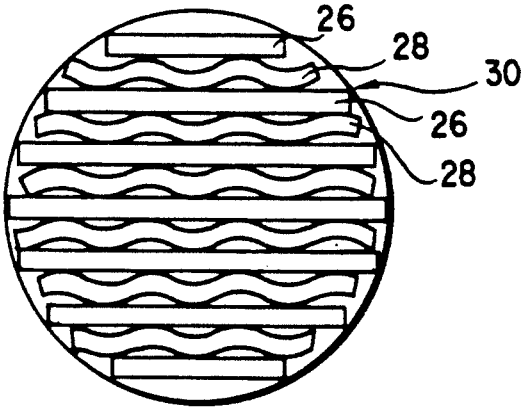
FIG. 10 schematically shows another porous thin plate used as a heat regenerative material.

Further, a plurality of straight wires 26 prepared as in Example 7 and a plurality of bent wires 28 as shown in FIG. 8 were alternately arranged side by side, followed by applying a heat treatment at 700° C. for 100 hours to the resultant array to obtain a porous thin plate as shown in FIG. 10. The porous thin plate thus obtained was found to exhibit an excellent performance like the porous thin plate prepared in Example 8.

As described above in detail, the present invention provides a regenerator loaded with a heat regenerative material which exhibits an excellent specific heat, an excellent heat transfer capability and recuperativeness under cryogenic temperatures. In addition, the heat regenerative material can be prepared at a relatively low cost. It should be noted that the heat regenerative material is used in the form of particles or filaments having a predetermined average diameter, making it possible to load the heat regenerative material regularly in the three dimensional direction. In this case, the loading rate of the heat regenerative material and the heat transfer characteristics between the heat regenerative material and the working medium such as a helium gas can be further improved, making it possible to provide a regenerator which permits suppressing the pressure loss.

What should also be noted is that the present invention provides a miniaturized refrigerator of 8K class or 4K class, which is provided with the particular regenerator and exhibits a high heat efficiency, an excellent heat transfer capability and recuperativeness.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A regenerator filled with a heat regenerative material comprising at least one compound represented by the following formula:

$$RM_{0.5}$$

where R is at least one rare earth element selected from the group consisting of Y, La, Ce, Pr, Nd, Pm, Sm, Eu, Gd, Tb, Dy, Ho, Er, Tm, Yb and Lu; and M is at least one metal selected from the group consisting of Al, Ga, In and Tl.

2. The regenerator according to claim 1, wherein said heat regenerative material is in the form of particles having an average diameter of 1 to 1,000 μm.

3. The regenerator according to claim 1, wherein said heat regenerative material is in the form of filaments having an average diameter of 1 to 1,000 μm.

4. A refrigerator comprising:

a refrigerant; and a heat regenerative material for performing heat exchange between said refrigerant and itself, wherein said heat regenerative material has a composition consisting essentially of a compound represented by the following formula:

$$RM_{0.5}$$

where R is at least one rare earth element selected from the group consisting of Y, La, Ce, Pr, Nd, Pm, Sm, Eu, Gd, Tb, Dy, Ho, Er, Tm, Yb and Lu; and M is at least one metal selected from the group consisting of Al, Ga, In and Tl.

5. The regenerator according to claim 4, wherein said heat regenerative material is in the form of particles having an average diameter of 1 to 1,000 μm.

6. The regenerator according to claim 4, wherein said heat regenerative material is in the form of filaments having an average diameter of 1 to 1,000 μm.

7. A regenerator filled with a heat regenerative material comprising at least one compound represented by the following formula:

$$(R1_{1-x}R2_x)_3M1M2_z$$

where R1 is at least one element selected from the group consisting of Dy, Ho, Er, Tm and Yb; R2 is at least one element selected from the group consisting of Sc, Y, La, Ce, Nd, Sm, Eu, Gd, Tb and Lu; M1 is at least one metal selected from the group consisting of Al, Ga, In and Tl; and M2 is at least one element selected from the group consisting of C, Si, Ge and B; and x and z are individually defined as $0 \leqq x \leqq 1$, $0 < z \leqq 1$.

8. The regenerator according to claim 7, wherein said M1 is Al, and said M2 is C.

9. The regenerator according to claim 7, wherein said x is defined as $x < 1$.

10. The regenerator according to claim 7, wherein said x is defined as $x = 0$.

11. The regenerator according to claim 7, wherein said compound has a pervoskite structure.

12. The regenerator according to claim 7, wherein said heat regenerative material is in the form of particles having an average diameter of 1 to 1,000 μm.

13. The regenerator according to claim 7, wherein said heat regenerative material is in the form of filaments having an average diameter of 1 to 1,000 μm.

14. A refrigerator comprising:

a refrigerant; and a heat regenerative material for performing heat exchange between said refrigerant and itself, wherein said heat regenerative material has a composition consisting essentially of a compound represented by the following formula:

$$(R1_{1-x}R2_x)_3M1M2_z$$

where R1 is at least one element selected from the group consisting of Dy, Ho, Er, Tm and Yb; R2 is at least one element selected from the group consisting of Sc, Y, La, Ce, Nd, Sm, Eu, Gd, Tb and Lu; M1 is at least one metal selected from the group consisting of Al, Ga, In and Tl; and M2 is at least one element selected from the group consisting of C, Si, Ge and B; and x and z are individually defined as $0 \leqq x \leqq 1$, $0 < z \leqq 1$.

15. The regenerator according to claim 14, wherein said M1 is Al, and said M2 is C.

16. The regenerator according to claim 14, wherein said x is defined as $x < 1$.

17. The regenerator according to claim 14, wherein said x is defined as $x = 0$.

18. The regenerator according to claim 14, wherein said compound has a pervoskite structure.

19. The regenerator according to claim 14, wherein said heat regenerative material is in the form of particles having an average diameter of 1 to 1,000 μm.

20. The regenerator according to claim 14, wherein said heat regenerative material is in the form of filaments having an average diameter of 1 to 1,000 μm.

* * * * *